US006382057B1

(12) United States Patent
Kienholz

(10) Patent No.: US 6,382,057 B1
(45) **Date of Patent: *May 7, 2002**

(54) RIGHT ANGLE WRENCH SOCKET WRENCH ADAPTOR

(76) Inventor: Charles F. Kienholz, 1360 Riverside Dr., Brainerd, MN (US) 56401

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/219,287

(22) Filed: Dec. 22, 1998

(30) Foreign Application Priority Data

Oct. 31, 1998 (KR) ..... 98-46724

(51) Int. Cl.[7] ..... B25B 23/16
(52) U.S. Cl. ..... 81/177.2; 81/436
(58) Field of Search ..... 81/177.2, 436, 81/177.1; 279/9.1, 91, 93

(56) References Cited

U.S. PATENT DOCUMENTS

| | | | | |
|---|---|---|---|---|
| 2,346,364 A | | 4/1944 | Dowe | |
| 2,593,828 A | * | 4/1952 | Arey | 81/177.2 |
| 2,713,281 A | * | 7/1955 | Poteet | 81/177.2 |
| 2,719,042 A | * | 9/1955 | Espy | 81/177.2 |
| 2,726,091 A | | 12/1955 | Topar | |
| 2,842,020 A | * | 7/1958 | Tarquinio | 81/177.2 |
| 2,851,915 A | | 9/1958 | Martinez | |
| 3,766,811 A | * | 10/1973 | Callahan | 81/177.2 |
| 3,850,056 A | * | 11/1974 | Allen | 81/177.2 X |
| 4,043,230 A | | 8/1977 | Scrivens | |
| 4,566,357 A | * | 1/1986 | Carossino | 81/177.2 |
| 4,982,632 A | | 1/1991 | Barmore | |
| 5,765,454 A | * | 6/1998 | Barbulescu et al. | 81/177.1 X |

FOREIGN PATENT DOCUMENTS

| | | |
|---|---|---|
| JP | 62-148167 | 7/1987 |

* cited by examiner

*Primary Examiner*—James G. Smith
(74) *Attorney, Agent, or Firm*—Merchant & Gould P.C.

(57) ABSTRACT

An adapter for adapting a right-angle wrench, such as an Allen wrench, to a socket wrench or ratchet handle is disclosed. The adapter comprises an upper adapter housing, a lower adapter housing which receives the upper adapter housing, and an insert portion insertable in the lower adapter housing. The upper adapter housing has a rectangular recessed socket opening at a top end and a lower externally threaded portion toward a bottom end. The lower externally threaded portion defines a transverse channel with an upper bearing surface for accommodating handle portions of the right-angle wrenches. The upper bearing surface may be configured with an angular taper. The lower adapter housing has an axial hole at a bottom end and an externally threaded portion towards a top end which receives the lower externally threaded portion. Right-angle wrenches are snugly accommodated in the axial hole of the lower adapter housing by the insert portion.

19 Claims, 2 Drawing Sheets

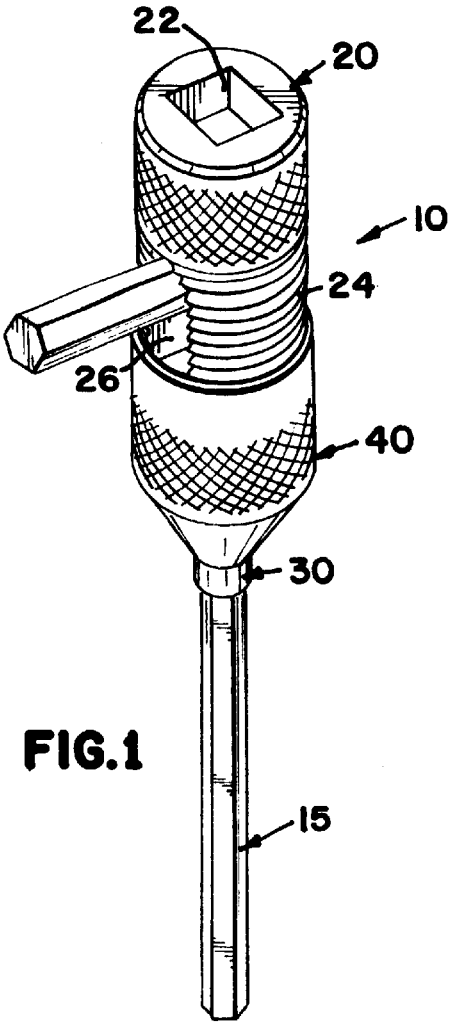
FIG.1
FIG.3
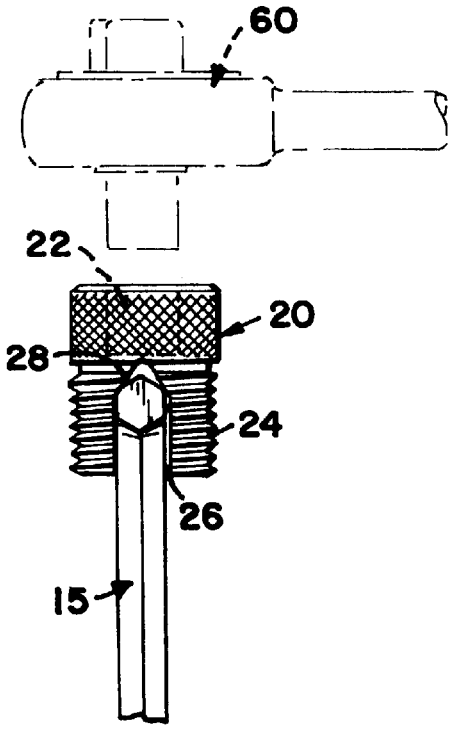
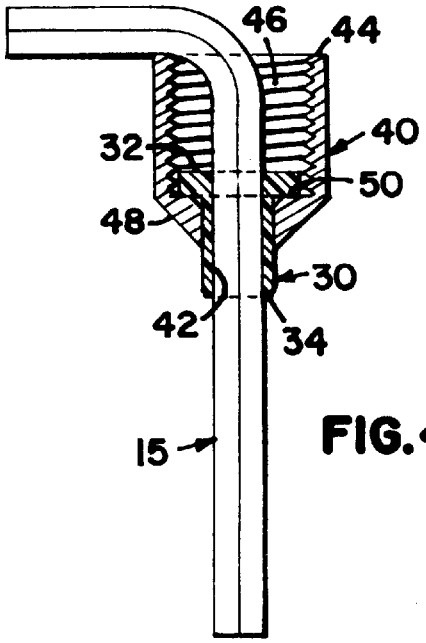
FIG.4

RIGHT ANGLE WRENCH SOCKET WRENCH ADAPTOR

The present invention generally relates to tool adapters, and in particular to adapters for adapting right angle wrenches for use with socket sets, such as the standard rectangular drive end of a ratchet handle.

BACKGROUND OF INVENTION

In the general field of applied mechanics, there are a multitude of applications where devices are tightened or loosened using hexagonal socket keys, or right angle wrenches, sometimes referred to as Allen wrenches. The terms "right angle wrench" and "Allen wrench" will typically used interchangeably heroin. The Allen wrench is typically an extended piece of metal with an hexagonal cross section along its entire length. The wrench typically has the shape of an 'L' and both ends of the piece may be used for tightening or loosening bolts or other items which have hexagonal recesses in their heads corresponding to the cross-sectional size of the specific Allen wrench.

When using the Allen wrench for tightening a bolt where only a moderate amount of torque is necessary, a person can simply tighten the bolt while holding the Allen wrench in one hand. To get the maximum torque while tightening a bolt, the user will typically hold on to the longer 'L' section of the Allen wrench and use the end of the shorter 'L' section to engage the bolt head. If the bolt is located in crowded or narrow space, it may be necessary to hold on to the shorter portion of the Allen wrench while tightening the bolt, which typically results in tightening the bolt with less torque. In many mechanical applications, bolts must be tightened with a higher amount of torque than can be exerted by hand tightening without the use of additional tools. Accordingly, removing bolts tightened with tools will require tools to loosen as well.

A number of devices for holding an Allen wrench while tightening or loosening bolts are known. Some fasten the Allen wrench at the lower end of the, shaft which has a T-bar handle at its upper end, whereby the user can tighten or loosen bolts with an increased amount of torque. Other devices use a locking screw by which the Allen wrench is secured to the adapter. The locking screw may be actuated with a screw-driver or with one's fingers. Other devices fasten the Allen wrench in a chuck at the lower end of the device.

What would be desirable is an adapter that would allow the convenience of an Allen wrench yet provide the torque produced by a socket wrench. Such as adapter should be durable, easy to assemble, and easy to disassemble after use.

SUMMARY OF THE INVENTION

The present invention relates to an adapter for accepting a standard right-angle wrench, such as an Allen wrench, which can be used with a socket wrench or ratchet handle. In accordance with one aspect of the invention, an adapter for adapting right-angle wrenches to socket wrenches comprises an upper adapter housing, a lower adapter housing which receives the upper adapter housing, and an insert portion insertable in the lower adapter housing. The upper adapter housing has a rectangular recessed socket opening at a top end adapted for receiving the drive portion of a socket wrench and a lower externally threaded portion toward a bottom end. The lower externally threaded portion defines a transverse channel with an angular taper for accommodating handle portions of the wrenches. The lower adapter housing has an axial hove at a bottom end and an internally threaded portion towards a top end which receives the lower externally threaded portion of the upper adapter housing. The angled wrenches are snugly accommodated in the lower adapter housing by an insert member and pass through the axial hole of the lower adapter housing. Once the wrench is so adapter with the adapter of the present invention, a socket or ratchet wrench handle can be used to turn the right-angle wrench. The assembly of the right-angle wrench and socket or ratchet handle can then be used to actuate bolts in either a clockwise (tightening) or counter-clockwise (loosening) direction.

One advantage of the present invention is that the adapter is a durable device that is easy to assemble. A minimal number of pieces greatly reduces any complicated assembly. The various pieces are sized to easily fit together and to work with various sizes of right-angle wrenches. The angular taper of the lower adapter housing accommodates the handle portions of the right-angle wrenches to facilitate an accurate and reliable operation of the device.

These and various other advantages and features of novelty which characterize the invention are pointed out with particularity in the claims annexed hereto and forming a part hereof. However, for a better understanding of the invention, its advantages and the objects obtained by its use, reference should be made to the accompanying drawings and descriptive matter which form a further Wart hereof, and in which is illustrated and described a preferred embodiment of the invention.

BRIEF DESCRIPTION OF THE DRAWINGS

In the drawings, wherein the corresponding reference numerals generally indicate corresponding parts throughout the several views;

FIG. 1 is a perspective view of one embodiment of an assembled adapter and Allen wrench in accordance with the invention;

FIG. 3 is a side view of an embodiment of the upper adapt housing portion of the adapter illustrated in engagement with one arm of an Allen wrench; and FIG. 4 is a side view in partial cross-section of the lower adapter housing portion of the adapter illustrated with an insert member portion and an Allen wrench.

DETAILED DESCRIPTION OF THE PREFERRED EMBODIMENT

Figure 2:
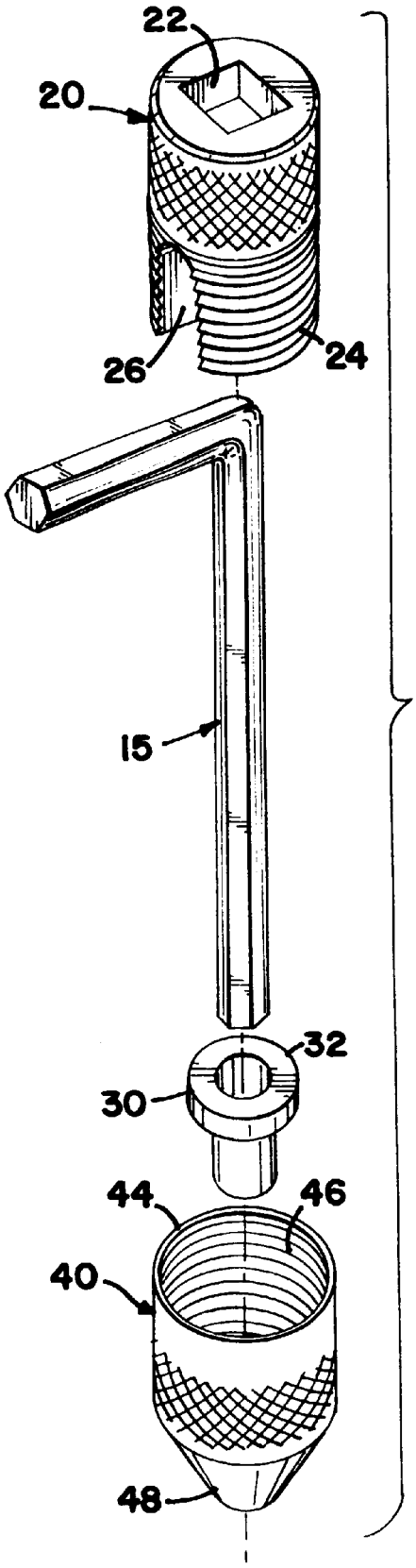
FIG. 2 is an exploded perspective view of the adapter shown in FIG. 1.

As discussed above, the present invention can be used in conjunction with any right-angle wrench, such as an Allen wrench, a right-angle TORX® wrench or a ball ended wrench, such as those available, for example, from Bondhus. Preferably, the wrench is a hexagonal wrench. To simplify the description of the present invention, an Allen wrench has been used throughout the following description.

Referring to the Figures, wherein like numerals represent like parts throughout the several views, an assembled adapter 10 for use with an Allen wrench (or other right-angle wrench) is shown in FIG. 1. The adapter is designed to increase the amount of torque that can be achieved from the Allen wrench by providing a medium for turning the Allen wrench with a socket or ratchet wrench. The assembly is also designed to accommodate various sized (including metric or English) Allen wrenches.

In FIG. 2, an exploded view of the embodiment of the invention is shown together with an exemplary Allen wrench 15. An upper adapter housing 20 is shown above Allen wrench 15, and an insert portion 30 and a lower adapter housing 40 are shown below Allen wrench 15. The assembled parts of the adapter 10 are coaxially aligned about a central axis (not shown) which passes through the centers of upper adapter housing 20, the long portion of Allen wrench 15, insert portion 30, and lower adapter housing 40.

The upper and lower adapter housings 20 and 40 should be manufactured from materials with sufficient rigidity and strength to withstand the force that generally are used in tightening and loosening bolts with Allen wrenches. Typically, the upper and lower adapter housings 20 and 40 will be made of metal, for example carbon steel, mild steel, stainless steel, or alloys, however, composites or other high strength materials may be used. The upper and lower adapter housings 20 and 40 may be molded, forged, machined or otherwise shaped to appropriate size.

In the preferred embodiment illustrated, the upper adapter housing 20 is a substantially cylindrical housing, however other shapes may be suitable for particular applications. The upper adapter housing 20 has a rectangular recessed hole 22 centered at and extending into the upper adapter housing 20 from its top end.,The recessed hole 22 has dimensions which correspond to the standard size rectangular drive end of a socket wrench or ratchet handle, typically ⅜ or ½ inch. FIG. 3 shows, in phantom, a ratcheting or socket handle 60 poised for engagement in recessed sole 22. The outer cylindrical surface of the upper portion of the adapter housing 20 is,knurled to enhance hand/finger griping and turning of the adapter housing 20. The lower portion 24 of the upper adapter housing 20 is externally threaded. It is noted that the number and size of the threads in the lower threaded portion 24 is exemplary only, and that different numbers and/or sizes of threads may be used in particular applications of the invention. The lower threaded portion 24 of the upper housing 20 may be a solid piece or may be a hollow cylinder with external threads.

A transverse channel 26 is formed through at least a part of the lower threaded portion 24. In one embodiment, transverse channel 26 extends from the center point at the bottom of lower threaded portion 24 to the outer edge of lower threaded portion. Alternately, transverse channel 26 may extend across the entire diameter of lower threaded portion 24. Channel 26 extends vertically down through the upper housing from a position near the top of the threads and down to open at the lower surface of the adapter housing 20. When the adapter is assembled with an Allen bench 15 as shown in FIG. 1, the transverse channel 26 accommodates the Allen wrench 15 at its bend. That is, at least a portion of each of the short and long portions of the 'L' will lie within and be retained by the channel 26. The center axis of Allen wrench 15 should be centered in lower threaded portion 24, as discussed more fully below.

At its widest point, transverse channel 26 has a width equal to or greater than the largest Allen wrench 15 that will be used with the adapter. As shown in FIG. 3, the transverse channel 26 preferably has parallel side walls progressing to an angular taper 28 at its top end. The short handle portion of the Allen wrench 15 is shown seated in the transverse channel 26. The taper 28 allows various sized Allen wrenches 15 to be securely engaged by and against the upper tapered wall portions of the transverse channel 26. Angular taper 28 may comprise two tapered surfaces angled at about 60 degrees from each other, although other angles are useable.

The lower adapter housing 40, shown in FIG. 2, is a substantially cylindrical element with a top end and a bottom end. The lower adapter housing 40 has an upper internally threaded portion 46 extending downward from its top end 44. The top end 44 of the lower adapter housing 40 will engage and actuate a surface of the Allen wrench 15 during assembly of the adapter 10 and during use of the adapter. For this and other purposes, the top end 44 may comprise a substantially flat bearing surface extending around the periphery of the top end 44 of the lower adapter housing 40. Lower adapter housing 40 may also have a tapered surface 48 extending in frusto-conical manner toward the bottom end of housing 40. In the preferred embodiment illustrated, the outer cylindrical surface of the lower adapter housing 40 is knurled to enhance hand/finger gripping and turning of the adapter housing 40.

Insert portion 30 is coaxially positioned within the interior of lower adapter housing 40 and is used to coaxially align and to maintain such alignment of the Allen wrench 15 relative to the adapter and to ensure a snug fit between the Allen wrench 15 and the adapter. Insert 30 should be sized to cooperatively fit within the internal cavity of lower adapter housing 40 without lateral movement. The insert portion 30 has an inner diameter bore sized to allow a particular Allen wrench 15 to be snugly fit within and through the insert portion 30. Since Allen wrenches 15 come in varying cross-sectional dimensions, it is contemplated that a number of insert portions 30 will be used with the adapter, each having a different cross-sectional bore diameter to accommodate a different sized Allen wrench. Preferably, insert portion 30 is easily removable from and replaceable into lower adapter housing 40, so that when needed insert 30 can be removed and replaced with a correctly sized insert 30 for accommodating the size of the Allen wrench 15 that will be used with the adapter. Each insert portion 30 has an inner diameter that allows an Allen wrench 15 of particular cross section diameter to be snugly fit inside the insert portion 30. Although Allen wrench 5 has a hexagonal cross section, insert portion 30 may have hexagonal, circular, square, or any other internal diameter shape that will snugly, retainably hold Allen wrench 15. The insert is configured such that the Allen wrench 15 retained thereby can rotate about its central axis when within insert portion 30.

Insert portion 30 is generally an elongated sleeve but may also have a radially extended shoulder portion 32 at its top end. The radially extended shoulder portion 32 engages and seats within the lower adapter housing 40 when the adapter has been assembled. Typically, radially extended shoulder portion 32 engages the interior of housing 40 at either a bearing surface formed in the tapered area of lower adapter housing 40 or within the internally threaded portion 40. Insert portion 30 may have an external taper 34 at its bottom end. The taper 34 (illustrated in FIG. 4) may, for example, facilitate insertion of insert portion 30 into and through the lower adapter housing 40. The insert portion 30 may be formed from a number of different materials, such as hard resilient materials, for example plastic or rubber.

FIG. 4 shows a cross-section of the lower adapter housing 40, the insert portion 30 and the Allen wrench 15 as they would be cooperatively assembled relative to one another prior to use. Allen wrench 15 is inserted within the insert portion 30 and the assembly is fitted through an axial hole 42 formed through the bottom end of the lower adapter housing 40. Allen wrench 15 is inserted into the lower adapter housing 40 until the upper handle portion of the Allen wrench 15 abuts and engages the top end 44 of the lower adapter housing 40. Axial hole 42 has an inner diameter that accommodates the external diameter of the insert portion 30 such that the inner surfaces of the lower adapter housing which define the hole 42 snugly support and engage the outer surface of the insert portion 30, preventing lateral movement the insert portion and maintaining the Allen wrench in coaxial alignment within the adapter 10.

The lower adapter housing 40 may have an internal radial seat portion 50 adjacent its bottom end for engaging the upper shoulder portion of insert portion 30, wherein the axial hole 42 is formed through the radial seat portion 50. Particularly, if the insert portion 30 has a radially extended shoulder portion 32 at its top end, the shoulder portion 32 may engage the radial seat portion 50 to help fit the Allen wrench 15 snugly in the adapter and to provide structural integrity. The inner most edge or radial seat portion 50 may include a bevel to facilitate the insertion and seating of insert portion 30.

The upper internally threaded portion 46 of the lower adapter housing 40 threadably engages the lower externally threaded portion 24 of the upper adapter housing 24. The upper internally threaded portion 46 will have threads of a size and number corresponding to those of the lower threaded portion 24 allow upper and lower adapters 20 and 40 to be engaged. As noted above, the number and size of the threads in the illustration of the upper internally threaded portion 46 is exemplary only. The upper internally threaded portion 46 may extend the entire internal length of lower adapter housing 40. Alternately, threaded portion 40 may begin slightly below the top end 44 of the lower adapter housing 40 and may extend to slightly above radial seat portion 50. Any non-threaded distances may be chosen depending on the particular application. Suitable distances range from about 0.5 to 3 mm. The non-threaded areas may facilitate a snug fit between the Allen wrench 15 and the adapter 10 and increase structural integrity of the adapter.

An exemplary use of an embodiment of the invention will be described. In consideration of the particular Allen wrench 15 that is to be used, the appropriately sized insert portion 30 is selected. It is contemplated that the adapter will be provided with a suitable selection of insert portions 30, corresponding to the sizes of Allen wrenches 15 with which the adapter is to be used. The longer shaft portion of the Allen wrench 15 is inserted through the insert portion 30 and extends downward beyond the lower edge of the insert. For example, if the insert portion 30 includes a radially shoulder portion 32, the Allen wrench 15 is inserted from that end of the insert portion 30. The Allen wrench 15 and insert 30 are then coaxially inserted into the lower adapter housing 40 from the top end 44 and through the hole 42 formed through the bottom of the adapter housing 40 until the insert 30 seats within the adapter housing 40. A part of the Allen wrench 15 and optionally a part of the insert portion 30 may extend through the axial hole 42 and beyond the lower end of the adapter housing 40. The adapter may at this point have a configuration substantially as the one shown in FIG. 4. In another embodiment, insert portion 30 is inserted into lower adapter housing 40 prior to insertion of Allen wrench 15 therein.

The lower externally threaded portion 24 of the upper adapter housing 20 is then threaded into the upper internally threaded portion 46 of the lower adapter housing 40. The shorter transverse arm of the Allen wrench 15 is first aligned with and rests within the transverse channel 26 of the upper adapter housing 20. Engagement of the Allen wrench short arm by the transverse channel 26 caused the Allen wrench to rotate about its longer arm axis (also the axis of the adapter) as the upper adapter housing 20 is threaded to the lower adapter housing 40. As the upper adapter housing 20 is threaded down into the lower adapter housing 40, the angular taper surface 28 of channel 26 will engage Allen wrench 15. For example, the taper surfaces of the angular taper 28 may engage two surfaces of the Allen wrench 15. The upper adapter housing 20 is threaded down into the lower adapter housing 40 until the transverse short arm portion of Allen wrench 15 is snugly secured between the upper and lower adapter housings 20 and 40. As the upper adapter housing 20 is threaded down, the top end 44 of the lower adapter housing 40 will abut and engage the lower surface of the handle portion of the Allen wrench 15. The top end 44 of the lower adapter housing 40 will bias the upper surface of the handle portion of the Allen wrench 15 against the angular taper surfaces 28 of the transverse channel 26. The handle portion of the Allen wrench 15 thereby seats in tight friction fit against and between the top end 44 of the lower adapter housing 40 and the tapered surfaces 28 of the upper adapter housing 20.

The threads of the upper and lower adapter housings 20 and 40 are configured such that the snug seating action between the upper and lower adapter housings with the Allen wrench 15 therebetween causes a frictional fit between and along the lengths of the threads that allows the assembly 10 to be turned in either a clockwise or counter-clockwise manner by a socket wrench, without loosening the threaded engagement between the upper and lower housings 20 and 40. It has been found that once the upper and lower housing 20 and 40 are tightly engaged, they should not loosen until unfastened.

To unfasten or decouple the upper and lower adapter housings 20 and 40, one simply provides a single lateral impact blow or rap to the upper adapter housing 20 to "loosen" the above described threaded lock. The upper adapter housing 20 can thereafter be simply unthreaded by hand from the lower adapter housing 40.

The described embodiment of the invention provides a practical and handy adapter for adapting Allen wrenches to be driven by socket wrenches. The adapter is easily assembled, and can be used for applying torque to suitable bolts in either a clockwise or counter-clockwise direction, without the upper and lower adapter housings 20 and 40 unscrewing. After using the adapter, the upper and lower adapter housings 20 and 40 can easily be dissembled for example to replace the Allen wrench with one of a different size.

It is to be understood that though numerous characteristics and advantages of the invention have been set forth in the forgoing description, together with details of the structure and function of the invention, the disclosure is illustrative only, and changes may be made in detail, especially in matters in shape, size, and arrangement of the parts within the principles of the invention to the full extent indicated by the broad general meanings of the terms in which the appended claims are expressed.

I claim:

1. An adapter for adapting right-angle wrenches to socket wrenches comprising:

an upper adapter housing having a rectangular recessed socket opening at a top end and a lower externally threaded portion toward a bottom end, the lower externally threaded portion defining a transverse channel with an angular taper for accommodating handle portions of the right-angle wrenches;

a lower adapter housing having an axial hole therethrough and an upper internally threaded portion toward a top end, which upper internally threaded portion receives the lower externally threaded portion; and an insert portion, insertable into the lower adapter housing, for snugly accommodating a lower shaft portion of the right-angle wrench in the axial hole of the lower adapter housing.

2. The adapter of claim 1, wherein the upper adapter housing is substantially cylindrical.

3. The adapter of claim 1, wherein the transverse channel comprises two substantially parallel channel surfaces extending from the bottom end of the upper adapter housing toward the angular taper.

4. The adapter of claim 3, wherein the angular taper comprises two taper surfaces, wherein each taper surface joins one of the channel surfaces.

5. The adapter of claim 4, wherein the two taper surfaces are angled at about 60° from each other.

6. The adapter of claim 1, wherein the lower adapter housing is substantially cylindrical.

7. The adapter of claim 1, wherein the upper internally threaded portion begins at a distance from the top end of the lower adapter housing.

8. The adapter of claim 1, wherein the lower adapter housing has an internal radial seat portion adjacent the bottom end, for engaging the insert portion.

9. The adapter of claim 8, wherein the upper internally threaded portion ends at a distance spaced from the internal radial seat portion.

10. The adapter of claim 1, wherein the lower adapter housing has an external taper at the bottom end through which the axial hole is formed.

11. The adapter of claim 6, wherein the top end of the lower adapter housing has a substantially flat bearing surface around a periphery of the lower adapter housing for engaging a surface of the right-angle wrench when the adapter is assembled.

12. The adapter of claim 1, wherein the insert portion comprises a substantially tubular portion.

13. The adapter of claim 12, wherein the insert portion further comprises an extended portion at a top end for abutting the lower adapter housing, and a tapered section at a bottom end.

14. The adapter of claim 12, wherein the insert portion has an external diameter substantially equal to an inner diameter of the axial hole in the lower adapter housing.

15. The adapter of claim 12, wherein the insert portion has an internal diameter to snugly accommodate the particular right-angle wrench.

16. The adapter of claim 1, wherein the right-angle wrench is a hexagonal wrench.

17. The adapter of claim 1, wherein said lower shaft portion of the right-angle wrench has a polygonal cross-sectional shape.

18. An adapter for adapting right-angle wrenches to socket wrenches comprising:

an upper adapter housing having a rectangular recessed socket opening at a top end and a lower externally threaded portion toward a bottom end, the lower externally threaded portion defining a transverse channel with an upper bearing surface for accommodating handle portions of the right-angle wrenches, the transverse channel comprising two substantially parallel channel surfaces extending from the bottom end of the upper adapter housing toward the upper bearing surface;

a lower adapter housing having an axial hole at a bottom end and an upper internally threaded portion toward a top end, which upper internally threaded portion receives the lower externally threaded portion, wherein the top end of the lower adapter housing has a substantially flat surface around a periphery of the lower adapter housing for engaging a surface of the right-angle wrench when the adapter is assembled; and an insert portion, insertable into the lower adapter housing, for snugly accommodating the right-angle wrenches in the axial hole of the lower adapter housing, wherein the insert portion further comprises an extended shoulder at a top end for abutting the lower adapter housing.

19. The adapter of claim 1, wherein the right-angle wrench comprises a ball ended wrench.

* * * * *

UNITED STATES PATENT AND TRADEMARK OFFICE

CERTIFICATE OF CORRECTION

PATENT NO. : 6,382,057 B1
DATED : May 7, 2002
INVENTOR(S) : Kienholz

It is certified that error appears in the above-identified patent and that said Letters Patent is hereby corrected as shown below:

Title page,
Item [54], Title, "RIGHT ANGLE WRENCH SOCKET WRENCH ADAPTOR" should read -- RIGHT ANGLE SOCKET WRENCH ADAPTOR --

Item [76], Inventor, "1360 Riverside Dr." should read -- 15311 Riverside Dr. --

Column 2,
Line 1, "hove" should read -- hole --
Line 7, "so adapter" should read -- so adapted --
Line 27, "Wart" should read -- part --
Line 41, "adapt" should read -- adapter --

Column 3,
Line 10, "force" should read -- forces --
Line 23, "end., The" should read -- end. The --
Line 27, "sole" should read -- hole --
Line 29, "is,knurled" should read -- is knurled --
Line 47, "Allen bench" should read -- Allen wrench --

Column 4,
Line 36, "Allen wrench 5" should read -- Allen wrench 15 --

Column 5,
Line 4, "movement the insert" should read -- movement of the insert --
Line 22, "portion 24 allow" should read -- portion 24 to allow --

Signed and Sealed this

Tenth Day of December, 2002

JAMES E. ROGAN
*Director of the United States Patent and Trademark Office*